US010710396B1

(12) United States Patent
Omori et al.

(10) Patent No.: US 10,710,396 B1
(45) Date of Patent: Jul. 14, 2020

(54) POCKET SHEET PROTECTOR AND BOOKLET THEREOF

(71) Applicant: LIHIT LAB., INC., Osaka-shi, Osaka (JP)

(72) Inventors: Akio Omori, Osaka (JP); Tamaki Sanada, Osaka (JP); Eri Kitahara, Osaka (JP)

(73) Assignee: LIHIT LAB., INC., Osaka-Shi (JP)

( * ) Notice: Subject to any disclaimer, the term of this patent is extended or adjusted under 35 U.S.C. 154(b) by 0 days.

(21) Appl. No.: 16/447,563

(22) Filed: Jun. 20, 2019

(51) Int. Cl.
*B42F 7/02* (2006.01)
*B42F 7/06* (2006.01)
*B42F 7/08* (2006.01)

(52) U.S. Cl.
CPC ..... *B42F 7/065* (2013.01); *B42F 7/02* (2013.01); *B42F 7/025* (2013.01); *B42F 7/08* (2013.01); *B42P 2241/20* (2013.01)

(58) Field of Classification Search
CPC ..... B42F 7/02; B42F 7/025
USPC ..... 402/79; 229/67.1, 67.3
See application file for complete search history.

(56) References Cited

U.S. PATENT DOCUMENTS 5,335,027 A * 8/1994 Lin ..... B42F 7/025 402/79
5,806,894 A * 9/1998 Dottel ..... B42F 7/025 402/79
6,168,340 B1 * 1/2001 Lehmann ..... B42F 11/00 402/79
7,614,815 B1 * 11/2009 Huang ..... B42F 11/02 402/79
9,457,611 B2 * 10/2016 Busam ..... B42F 7/02
2009/0290930 A1 * 11/2009 Rodriguez, Jr. ..... B42F 7/025 402/79

FOREIGN PATENT DOCUMENTS

DE 1536637 A1 * 1/1970 ..... B42F 7/025
EP 0509197 A1 * 10/1992 ..... B42F 7/02
EP 0933230 A1 * 8/1999 ..... F42F 7/02
GB 2187676 A * 9/1987 ..... B42F 7/02
JP 3177545 U 8/2012

OTHER PUBLICATIONS

Lihit Lab., Inc., "Info-Mail" Clear Pocket (Expandable), Japan, Jun. 28, 2018, vol. 2, p. 6 (4 pages provided).

* cited by examiner

*Primary Examiner* — Kyle R Grabowski
(74) *Attorney, Agent, or Firm* — Birch, Stewart, Kolasch & Birch, LLP

(57) ABSTRACT

A pocket sheet protector and a booklet thereof include a main body portion that is formed in a pocket shape. The main body portion includes a first welding line that divides the main body portion into an accommodating section and a binding margin in the vicinity of one side thereof, and a second welding line that seals the bottom side of the main body portion. Further, the main body portion includes, at a bottom side corner, a notched portion which extends closer to the accommodating section than the first welding line, and cuts out a lower end of the first welding line and an end of the second welding line.

2 Claims, 4 Drawing Sheets

POCKET SHEET PROTECTOR AND BOOKLET THEREOF

BACKGROUND OF THE INVENTION

Field of the Invention

The present invention relates to the field of pocket sheet protectors and booklets thereof that protect documents from bending and contamination.

Description of the Related Art

In order to protect documents against bending and contamination, a pocket sheet protector is used which contains the documents in a pocket made of a transparent resin sheet.

In relation to such a pocket sheet protector, Japanese Utility Model Registration No. 3177545 discloses an improvement in which non-welded portions which are not welded are disposed on both sides of a bottom welding line, so as to enable a thick document to be accommodated in the pocket sheet protector.

However, in the pocket sheet protector disclosed in Japanese Utility Model Registration No. 3177545, there is a problem in that a load is easily generated in the vicinity of a corner of the bottom portion when such a thick document is accommodated therein, and wrinkles and bending are likely to occur.

SUMMARY OF THE INVENTION

An aspect of the disclosure recited below is to provide a pocket sheet protector including a main body portion formed by overlapping a rectangular first sheet and a rectangular second sheet, and having a top side, a first side, a second side, and a bottom side, a first welding line formed to extend in parallel with the second side in the vicinity of the second side, and configured to divide the main body portion into an accommodating section on the first side, and a binding margin on the second side by welding the first sheet and the second sheet, a second welding line configured to seal the bottom side, a first notched portion in which a corner where the first side and the bottom side intersect is cut out, and a second notched portion in which a corner where the second side and the bottom side intersect is cut out, wherein the second notched portion extends closer to the accommodating section than the first welding line, and cuts out a lower end of the first welding line and an end of the second welding line.

Further, another aspect is to provide a booklet in which a plurality of the pocket sheet protectors having the above aspect are bound.

The above objects, features, and advantages of the present invention will be readily understood from the following description when taken with reference to the accompanying drawings.

DESCRIPTION OF THE PREFERRED EMBODIMENTS

Figure 1:
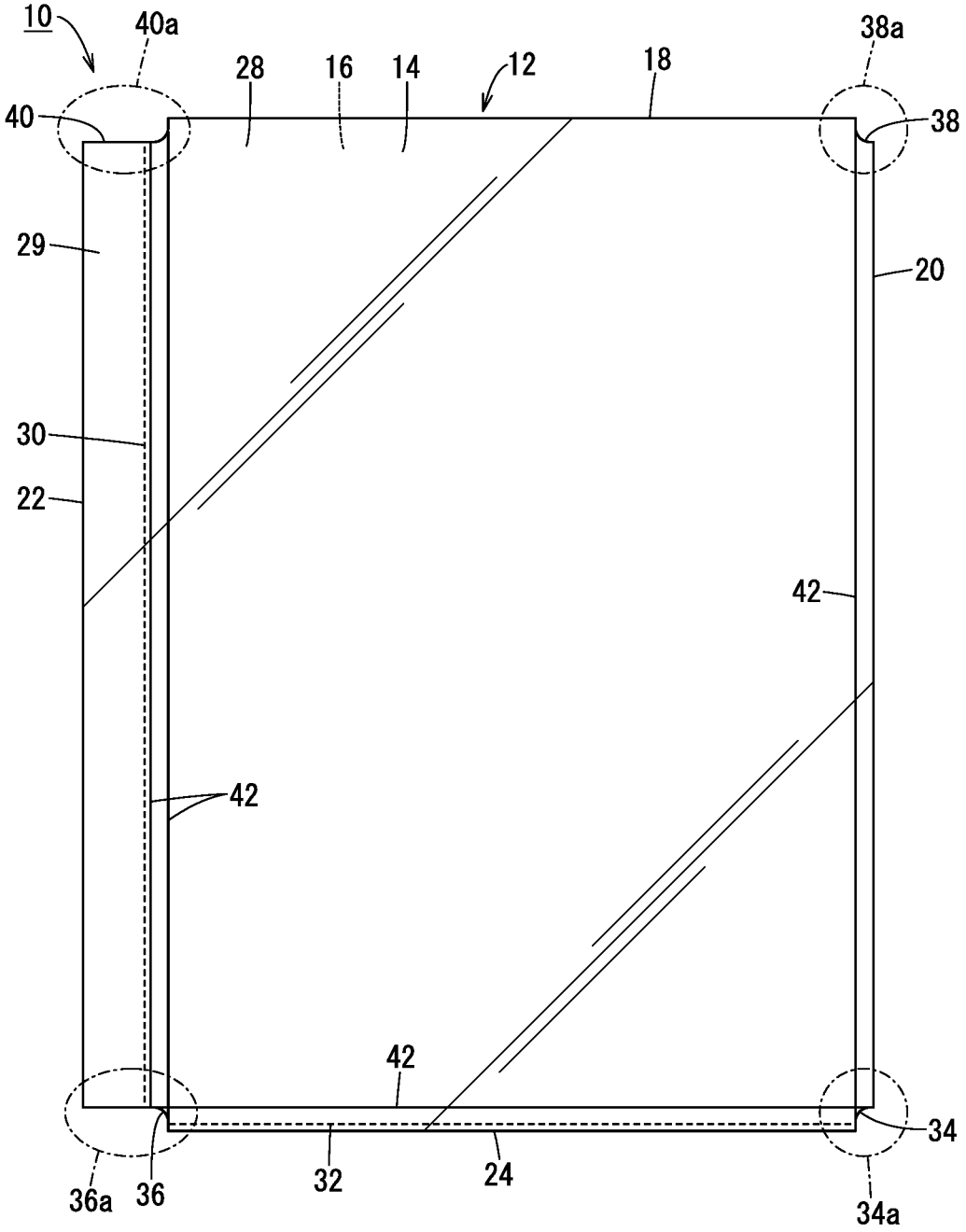
FIG. 1 is a plan view of a pocket sheet protector according to an embodiment of the present invention.

As shown in FIG. 1, a pocket sheet protector 10 according to the present embodiment includes a main body portion 12 formed in a rectangular pocket shape. The main body portion 12 is configured by overlapping a first sheet 14 and a second sheet 16 that are made from a resin film. The front side of the drawing sheet shows the first sheet 14, and the sheet that is superimposed on the back side is the second sheet 16. The resin films that make up the first and second sheets 14 and 16 are formed of a transparent and flexible thermoplastic resin such as polypropylene resin.

There are a plurality of types of structures for the main body portion 12, depending on the method used for forming the main body portion 12. A first structural example of the main body portion 12 is formed by a method in which the rectangular sheets 14 and 16 are prepared in the form of separate bodies, the sheets 14 and 16 are superimposed on each other, and both sides 20 and 22 and a bottom side 24 are welded together. The main body portion 12 made according to this method may be considered in the case of employing relatively thick sheets 14 and 16, and has welding lines formed on both sides 20 and 22 and the bottom side 24 thereof. Further, the main body portion 12 in accordance with a second structural example includes a configuration in which one sheet is folded at a first side 20, and after folding, a second side 22 and a bottom side 24 are welded. Moreover, the main body portion 12 in accordance with a third structural example may be formed by an inflation method. In a process of forming the main body portion 12 by using such an inflation method, a long tubular shaped resin sheet is formed by the inflation method, the tubular shaped resin sheet is pressed and flattened by a roller, the flattened resin sheet is cut into plural sheets each having a top side 18 and a bottom side 24, and the bottom side 24 is welded at a second welding line 32, to thereby form the main body portion. In any of these structural examples, a first welding line 30 is formed in the vicinity of the second side 22 to thereby divide the main body portion 12 into a binding margin 29 and an accommodating section 28. Although the present embodiment is not limited to any particular method, in the following description, an example will be presented in which the main body portion 12 is formed by the inflation method.

The main body portion 12 includes the top side 18, the first side 20, the second side 22, and the bottom side 24. The first side 20 and the second side 22 are formed as bent portions formed by pressing and flattening a tubular resin film. More specifically, the first sheet 14 and the second sheet 16 are integrally connected via the first side 20 and the second side 22. Further, the bottom side 24 is formed by joining and welding together the overlapped portions of the first sheet 14 and the second sheet 16. At an upper end of the main body portion 12, the first sheet 14 and the second sheet 16 are separated to thereby constitute an opening 26. An accommodated object (for example, a document) is accommodated via the opening 26 (see FIG. 3) in the accommodating section 28 which is formed between the first sheet 14 and the second sheet 16.

The main body portion 12 includes the first welding line 30 which is disposed in the vicinity of the second side 22, and the second welding line 32 which is disposed along the bottom side 24. The first welding line 30 and the second welding line 32 include a plurality of island shaped welded portions 33 (see FIG. 2) connected in a line. The first sheet 14 and the second sheet 16 are welded together at the welded portions 33.

Figure 4:
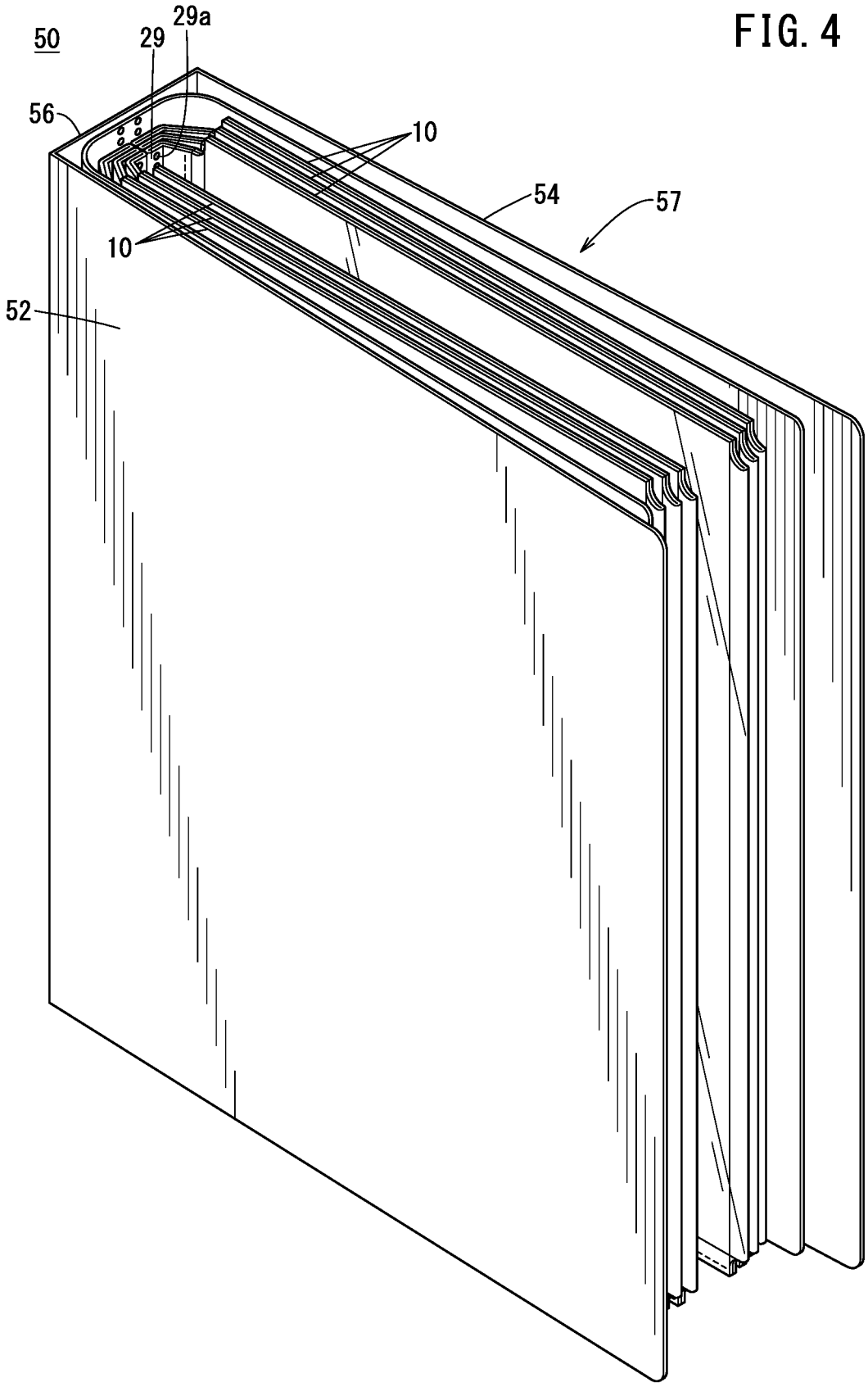
FIG. 4 is a perspective view of a booklet in which a plurality of the pocket sheet protectors of FIG. 1 are bound.

The first welding line 30 is formed to extend in a direction parallel to the second side 22, and the main body portion 12 is divided into the accommodating section 28 on the first side 20, and the binding margin 29 on the second side 22. The binding margin 29 is a portion located between the second side 22 and the first welding line 30, and is used for welding to a spine 56 of a later-described booklet 50 (see FIG. 4). In addition, in the case that the booklet 50 is provided with a ring-type metal binding fitting, the binding margin 29 may be equipped with a plurality of punched holes for attachment to the metal binding fitting.

The accommodating section 28 is a portion located between the first welding line 30 and the first side 20. In the accommodating section 28, the bottom side 24 is sealed by the second welding line 32, and the accommodating section 28 is formed in a pocket shape. The accommodating section 28 forms a space between the first sheet 14 and the second sheet 16 for accommodating the accommodated object (for example, a document).

In the pocket sheet protector 10 according to the present embodiment, a first notched portion 34 is formed at a corner 34*a* where the first side 20 and the bottom side 24 of the main body portion 12 intersect, and a second notched portion 36 is formed at a corner 36*a* where the second side 22 and the bottom side 24 intersect. The first notched portion 34 is formed by being cut out in a circular arc shape having a predetermined radius centered about the corner 34*a*. The first notched portion 34 leaves open a predetermined range of a lower end of the first side 20, and a predetermined range of an end of the second welding line 32 on the side of the first side 20. Consequently, the inner side and the outer side of the accommodating section 28 communicate with each other in the vicinity of the corner 34*a*.

Figure 2:
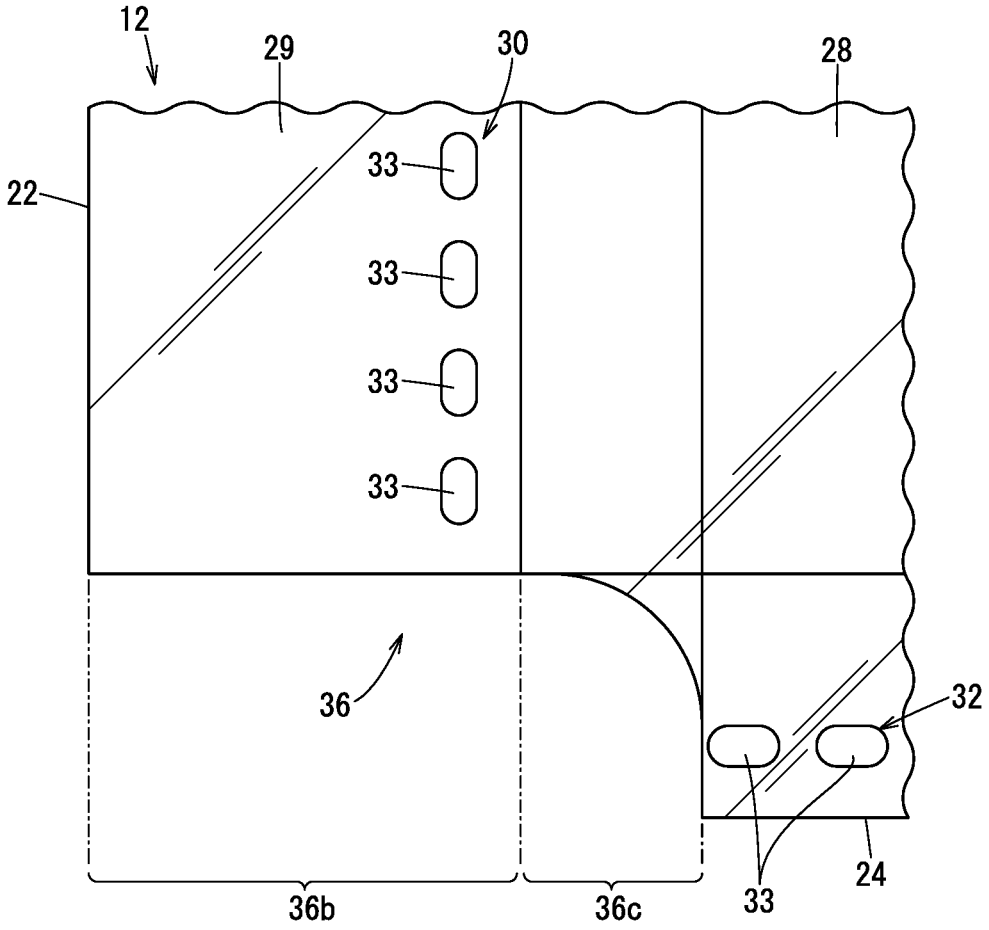
FIG. 2 is an enlarged view showing the vicinity of a lower end portion of a first welding line of the pocket sheet protector of FIG. 1.

As shown in FIG. 2, the second notched portion 36 comprises a straight portion 36*b* that is cut out in a straight line shape from the corner 36*a* toward the first side 20, and a tip end portion 36*c* that is cut out in an arcuate shape at an end on the side of the first side 20. The straight portion 36*b* cuts out the first sheet 14 and the second sheet 16 within a range from the second side 22 to the first welding line 30. The tip end portion 36*c* is formed to be connected to a side of the straight portion 36*b* that is closer to the first side 20. More specifically, the second notched portion 36 extends closer to the accommodating section 28 than the first welding line 30. The second notched portion 36 leaves open a predetermined range on the lower end of the first welding line 30, and a predetermined range of the second welding line 32. More specifically, the second notched portion 36 enables the inner side and the outer side of the accommodating section 28 to communicate with each other in the vicinity of the corner 36*a*.

Figure 3:
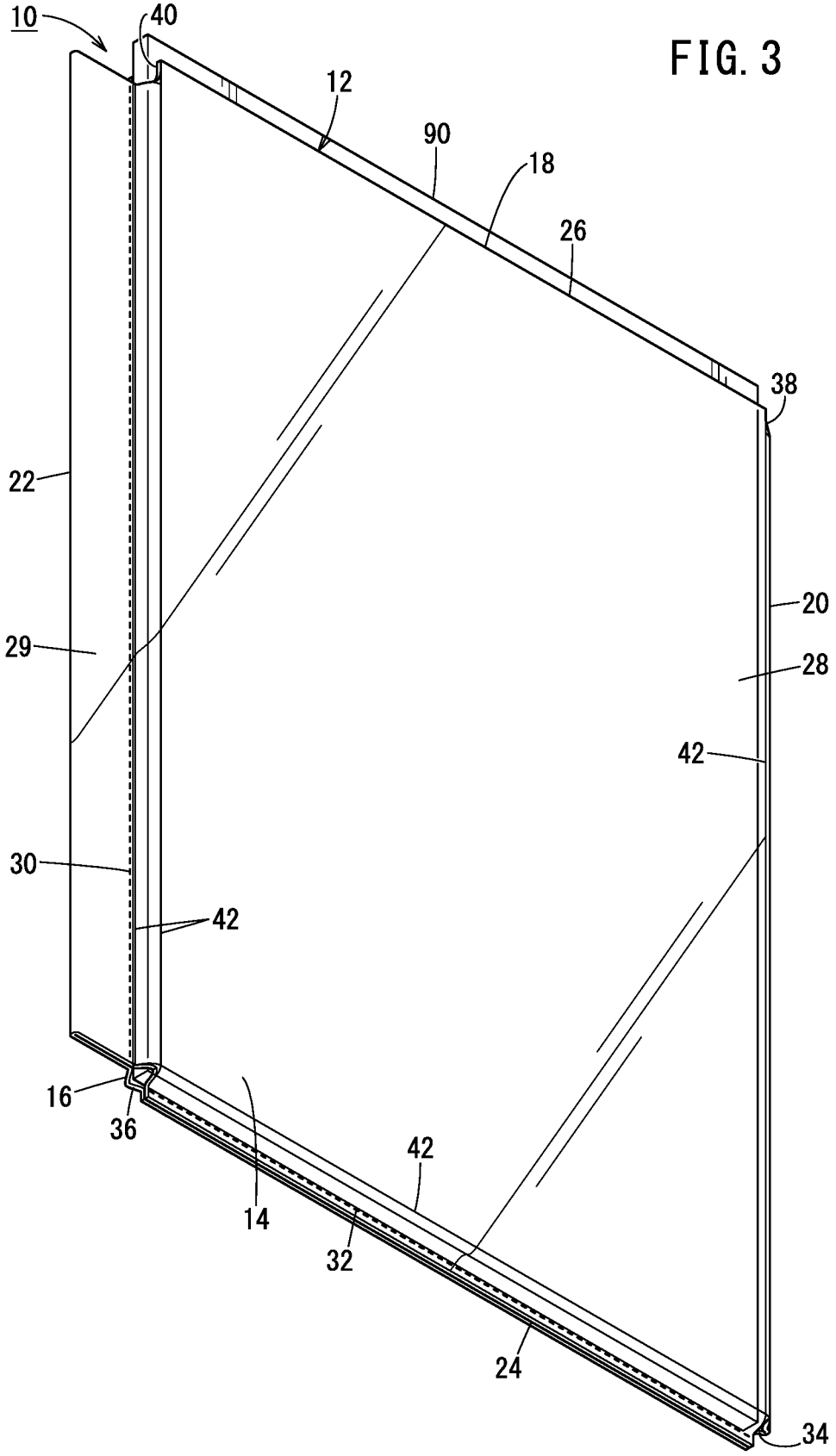
FIG. 3 is a perspective view showing a state in which a thick accommodated object is inserted into the pocket sheet protector of FIG. 1.

As shown in FIG. 3, when a thick accommodated object 90 is accommodated inside the pocket sheet protector 10, the accommodating section 28 expands or swells in accordance with the thickness of the accommodated object 90. At this time, the accommodating section 28 expands in a manner so that the first notched portion 34 and the second notched portion 36 open largely in the vicinity of the corners of the bottom side 24 where a large load acts. Consequently, it is possible to prevent wrinkles and deformation from occurring at the bottom side 24 of the accommodating section 28, and the thick accommodated object 90 can be neatly accommodated therein.

As shown in FIG. 1, in the pocket sheet protector 10, a third notched portion 38 is formed at a corner 38*a* where the first side 20 and the top side 18 intersect, and a fourth notched portion 40 is formed at a corner 40*a* where the second side 22 and the top side 18 intersect. The third notched portion 38 cuts out a predetermined range of an upper end of the first side 20. The fourth notched portion 40 is formed to extend closer to the accommodating section 28 than the first welding line 30, and cuts out a portion of an upper end of the first welding line 30. By enlarging the opening width of the top side 18 of the accommodating section 28, the third notched portion 38 and the fourth notched portion 40 facilitate taking the thick accommodated object 90 (see FIG. 3) in and out.

Hinge lines 42 are formed respectively in the vicinity of the first side 20, in the vicinity of the first welding line 30, and in the vicinity of the second welding line 32 of the main body portion 12. The hinge lines 42 are formed by introducing linear slits in the first sheet 14 and the second sheet 16. The hinge lines 42 facilitate the deformation of the first sheet 14 and the second sheet 16 when the thick accommodated object 90 (for example, a document) is inserted into the accommodating section 28, and facilitate the insertion of the accommodated object 90.

The pocket sheet protector 10 of the present embodiment is configured in the manner described above. Hereinafter, a description will be given concerning a booklet 50 in which a plurality of the pocket sheet protectors 10 are used.

The booklet 50 includes a booklet cover 57 comprising a front cover 52, a back cover 54 facing toward the front cover 52, and a spine 56 connecting the front cover 52 and the back cover 54, and a plurality of the pocket sheet protectors 10 which are bound inside the booklet cover 57. The front cover 52, the back cover 54, and the spine 56 are formed of a thick resin sheet or cardboard having a rigidity higher than that of the pocket sheet protectors 10. The pocket sheet protectors 10 are joined to the spine 56 of the booklet 50 via the binding margins 29 of the main body portions 12. As shown in the drawing, welded portions 29*a* are formed on the binding margins 29, and the binding margins 29 are joined to the spine 56 at the welded portions 29*a*. It should be noted that the means for joining the pocket sheet protectors 10 to the spine 56 is not limited to welding, and the means for joining may also be implemented using ring shaped metal binding fittings.

In the above description, although the present invention has been described with reference to a preferred embodiment, the present invention is not limited to this embodiment, and it goes without saying that various modifications and changes can be made therein without departing from the scope and gist of the present invention as set forth in the appended claims.

What is claimed is:

1. A pocket sheet protector comprising:

a main body portion formed by overlapping a rectangular first sheet and a rectangular second sheet, and having a top side, a first side, a second side, and a bottom side;

a first welding line formed to extend in parallel with the second side in a vicinity of the second side, and configured to divide the main body portion into an accommodating section on the first side, and a binding margin on the second side by welding the first sheet and the second sheet;

a second welding line configured to seal the bottom side;

a first notched portion in which a corner where the first side and the bottom side intersect is cut out;

a second notched portion in which a corner where the second side and the bottom side intersect is cut out; and hinge lines formed respectively in the vicinity of the first side, in the vicinity of the first welding line, and in the vicinity of the second welding line of the main body portion;

wherein the second notched portion extends closer to the accommodating section than the first welding line, and cuts out a lower end of the first welding line and an end of the second welding line;

said hinge lines are formed by linear slits in the first sheet and the second sheet;

one of said hinge lines extends parallel to the bottom side along the bottom side from an upper end of the second notched portion; and said hinge lines facilitate the deformation of the first sheet and the second sheet when an accommodated object is inserted into the accommodating section, and facilitate the insertion of the accommodated object.

2. A booklet comprising:

a booklet cover including a front cover, a back cover, and a spine formed between the front cover and the back cover; and a plurality of pocket sheet protectors joined to the spine;

each of the pocket sheet protectors comprising:

a main body portion formed by overlapping a rectangular first sheet and a rectangular second sheet, and having a top side, a first side, a second side, and a bottom side;

a first welding line formed to extend in parallel with the second side in a vicinity of the second side, and configured to divide the main body portion into an accommodating section on the first side, and a binding margin on the second side by welding the first sheet and the second sheet;

a second welding line configured to seal the bottom side;

a first notched portion in which a corner where the first side and the bottom side intersect is cut out; and a second notched portion in which a corner where the second side and the bottom side intersect is cut out; and hinge lines formed respectively in the vicinity of the first side, in the vicinity of the first welding line, and in the vicinity of the second welding line of the main body portion;

wherein the second notched portion extends closer to the accommodating section than the first welding line, and cuts out a lower end of the first welding line and an end of the second welding line; and said hinge lines are formed by linear slits in the first sheet and the second sheet;

one of said hinge lines extends parallel to the bottom side along the bottom side from an upper end of the second notched portion; and said hinge lines facilitate the deformation of the first sheet and the second sheet when an accommodated object is inserted into the accommodating section, and facilitate the insertion of the accommodated object.

* * * * *